United States Patent [19]

Ozawa et al.

[11] 4,347,299

[45] Aug. 31, 1982

[54] METHOD OF CONTROLLING TONER CONCENTRATION FOR ELECTROPHOTOGRAPHIC COPYING APPARATUS

[75] Inventors: Hiroshi Ozawa; Masao Tokumoto, both of Toyokawa, Japan

[73] Assignee: Minolta Camera Kabushiki Kaisha, Osaka, Japan

[21] Appl. No.: 67,238

[22] Filed: Aug. 16, 1979

[30] Foreign Application Priority Data

Aug. 16, 1978 [JP] Japan ..... 53-100309
Jan. 20, 1979 [JP] Japan ..... 54-5817

[51] Int. Cl.[3] ..... G03G 13/08; G03G 13/09

[52] U.S. Cl. ..... 430/122; 355/3 DD; 355/14 D

[58] Field of Search ..... 355/3 R, 3 DD, 14 R, 355/14 D; 430/120, 121, 122, 123

[56] References Cited

U.S. PATENT DOCUMENTS 3,453,045 7/1969 Fantuzzo ..... 355/3 DD
3,572,922 3/1971 Olden ..... 355/3 DD
3,920,329 11/1975 Dennie et al. ..... 430/122 X
3,924,462 12/1975 Bock ..... 355/3 DD X
3,932,034 1/1976 Takahashi ..... 355/3 DD
4,008,686 2/1977 Katakura et al. ..... 355/3 DD X
4,230,070 10/1980 Murasaki et al. ..... 355/3 DD X

FOREIGN PATENT DOCUMENTS 52-63739 5/1977 Japan .

*Primary Examiner*—Fred L. Braun
*Attorney, Agent, or Firm*—Wenderoth, Lind & Ponack

[57] ABSTRACT

A method of controlling toner concentration for an electrophotographic copying apparatus in which voltage to be impressed on a toner collecting or recovering roller disposed to contact a flow of a developing material after developing is arranged to vary so that a voltage lower than that for a reference density image is applied thereto for an image having a high density requiring a large toner consumption, while a voltage higher than that for the reference density image is applied thereto for an image having a low density requiring a small toner consumption.

15 Claims, 17 Drawing Figures

METHOD OF CONTROLLING TONER CONCENTRATION FOR ELECTROPHOTOGRAPHIC COPYING APPARATUS

BACKGROUND OF THE INVENTION

The present invention generally relates to electrophotography and more particularly, to a method of controlling toner concentration for an electrophotographic copying apparatus.

Conventionally, for supplying or replenishing toner in dry type electrophotographic copying apparatus, there has been employed an arrangement in which the toner is dispensed at a constant rate from a toner tank or hopper disposed on the upper portion of a developing device by gravity or through a rotating brush, roller or the like which is provided at a toner dispensing opening formed at a lower portion of the toner tank, while the amount of the toner to be supplied is externally controlled by mechanical means mainly based on the density and the like of copied images.

In the known toner dispensing device as described above, however, it is impossible to replenish the toner in proportion to an electrical charge on an electrostatic latent image which varies widely according to the density of originals to be copied. More specifically, when electrostatic latent images with low electrical charge are to be continuously developed, the amount of the toner within the developing device tends to become excessive, with the possibility that fogging and the like takes place in the copied images due to adhesion of toner onto non-image areas, or dust is produced by the excessive toner to soil the interior of the copying apparatus. On the contrary, continuous development of electrostatic latent images with high electrical charge may result in such inconveniences as reduction of image density due to deficiency of toner or undesirable adhesion of magnetizable carrier beads to the photosensitive member.

Accordingly, there has been required a toner dispensing device that will replenish toner in proportion to the density of originals, i.e. to the amount of electrical charge of the electrostatic latent image on the photosensitive member. For the above purposes, various devices have heretofore been proposed, for example, those which measure the density of the original images or copied images for controlling the amount of toner supply or those which control the toner replenishing amount by measurement of the amount of electrical charge on the surface of the photosensitive member. The proposed devices as described above which are adapted to control the toner concentration only at the toner supplying portions with the use of the rotating brush, roller and the like, however, have such drawbacks as being complex in construction, large-sized and expensive, thus failing to assure efficient and accurate control of toner concentration.

In order to overcome the disadvantages as described above, there has heretofore been proposed an arrangement, for example, in Japanese Laid Open Patent Application Tokkaisho 52-63739, in which toner is supplied to the developing device to satisfy the equation $F=M+Fl=$constant wherein F is the amount of toner to be supplied, Fl is the amount of toner to be recovered or collected by a toner collecting member on which a predetermined voltage opposite in polarity to the toner is impressed, and M is the amount of toner to be consumed in developing, with the toner concentration being represented by the percent of toner to carrier by weight.

Referring to FIG. 1, in the known method as described above, on the assumption that P and Q represent toner consumption and collection curves (M+Fl) respectively for no tone or entirely white originals and full tone or entirely black originals, when continuous copying of the full tone originals is effected, with toner supply in an amount of Fa and toner concentration of Da, the toner concentration remains stable at Da since the relation $Fa=M+Fl$ is satisfied. Subsequently, upon continuous copying of the no tone originals from the above state, the toner concentration is gradually increased by the difference between the toner supplying amount Fa and curve Q so as to be finally settled at a point B, since the toner consumption and collection amount for the no tone originals is at Fb with respect to the curve Q, and at the point B, the toner concentration becomes stable at Db, since the relation $Fa=M+Fl$ is met. From the above state, when the continuous copying is again effected for the full tone originals, the toner consumption and collection amount for the full tone originals at the concentration Db is gradually decreased by the difference between the curve P and the toner supplying amount Fa so as to be finally settled at a point A, since the toner consumption and collection amount for the full tone originals at the concentration Db is Fc from the curve P. As is seen from the foregoing, according to said known method, the toner concentration varies between the points Da and Db depending on the originals, and according to the experiment carried out by the present inventors, it has been found that when 5 weight % is taken as a reference value or central value of the variation, the variation becomes as large as 2.8 percent % at an impressed voltage of 700 V, and 4 weight % at an impressed voltage of 400 V. The large variation in the toner concentration as described above according to the originals results in such inconveniences as insufficient developing density on the low concentration side and generation of fogging on the high concentration side.

Moreover, although the triboelectrically chargeable toner is given a triboelectrical charge by stirring in the developing device, the stirring capacity of ordinary developing devices is not very large, so that insufficient triboelectrical charging takes place at the high concentration side of the concentration variation, thus giving rise to the problem that the interior of the copying apparatus is soiled by scattered toner particles. The drawbacks as described above may be eliminated to a certain extent by improving the stirring capacity, but are still extremely disadvantageous from the viewpoints of size-reduction and low cost of the copying apparatus.

Meanwhile, the variation of the toner concentration depending on the originals may be reduced by increasing the amount of toner recovery or collection with respect to the amount of developing toner so as to increase the inclinations of the curves P and Q for causing said curves P and Q to approach each other, but for the above purpose, it is required to increase the amount of toner supplied per unit time with respect to a reference value for the toner concentration. On the other hand, increasing the amount of toner supply as described above tends to cause deterioration of the toner charging, resulting in staining of the interior of the copying apparatus due to scattering of the toner.

For eliminating the disadvantages as described above, there has heretofore been proposed a new automatic toner replenishing device described in U.S. Patent Application Ser. No. 934,121 filed on August 16, 1978, now U.S. Pat. No. 4,230,070, and assigned to the same assignee as in the present application in which toner is supplied through recessed portions formed in a toner collecting roller so that part of said toner is always supplied into the developing device at a constant rate, while the remaining part of the toner is caused to contact the magnetic brush after the developing for replenishment according to the toner concentration of the developing material after the developing. While the variation of the toner concentration is reduced so that it is somewhat smaller than that in the earlier described Japanese Laid Open Patent Application Tokkaisho 52-63739, the reduction in the variation is not considered to be sufficient for substantial elimination of the disadvantages as described earlier.

SUMMARY OF THE INVENTION

Accordingly, an essential object of the present invention is to provide an improved method of controlling toner concentration for an electrophotographic copying apparatus which controls the toner concentration through a narrow control range with the supply of an optimum amount of toner.

Another important object of the present invention is to provide an improved method of controlling toner concentration as described above in which the variation in the toner concentration is made extremely small with respect to the density of original images to be copied for assuring favorable image quality, with reduction of the amount of toner to be supplied and elimination of the problems related to the scattering and formation of dust caused by the toner.

In accomplishing these and other objects, according to one preferred embodiment of the present invention, there is disclosed a method of controlling toner concentration for an electrophotographic copying apparatus which comprises the steps of recovering or collecting toner corresponding to concentration of a developing material which includes a triboelectrically chargeable toner and a magnetizable carrier, by a toner collecting roller impressed with a voltage opposite in polarity to the toner and disposed to contact a flow of said developing material after developing, supplying approximately a predetermined constant amount of toner for replenishing the toner thus collected, and varying or changing over the voltage impressed on the toner collecting roller into more than two stages so that a voltage lower than that for a reference density image is applied thereto for an image having a high density with a large toner consumption, while a voltage higher than that for the reference density image is applied thereto for an image having a low density with a small toner consumption.

By the method according to the present invention as described above, not only is the construction of the control device simplified and reduced in size, but owing to the small variation of the toner concentration as compared with that in the conventional methods, efficient rising of toner charging is achieved without employing a separate stirring device, resulting in less possibility of staining the interior of the copying apparatus due to scattering of toner.

BRIEF DESCRIPTION OF THE DRAWINGS

These and other objects and features of the present invention will become apparent from the following description of the preferred embodiments thereof and with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 2:
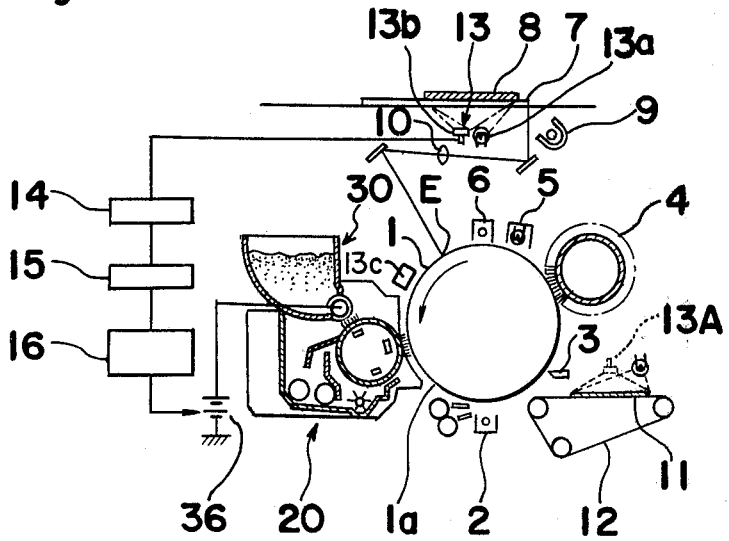
FIG. 2 is a schematic side sectional view of an electrophotographic copying apparatus to which a method of controlling toner concentration according to the present invention can be applied.

Referring now to the drawings, there is schematically shown in FIG. 2 an electrophotographic copying apparatus to which the method of controlling toner concentration according to the present invention can be applied. In FIG. 2, the copying apparatus includes a known photosensitive drum or photoreceptor 1 rotatably disposed at an approximately central portion thereof for rotation in the counterclockwise direction and having a photosensitive surface 1*a* provided on the outer periphery thereof, around which various processing stations such as a corona charger 6, an exposure station E, a developing device 20, a transfer charger 2, a copy paper separating device 3, a cleaning device 4, a charge eraser 5, etc. are sequentially disposed in a known manner. An original 8 to be copied which is placed on an original platform 7 disposed at the upper portion of the copying apparatus is illuminated by a light source or exposure lamp 9 which is provided below and adjacent to the platform 7, and the light image of the original 8 is successively projected at the exposure station E onto the photosensitive layer 1*a* of the photosensitive drum 1 preliminarily charged by the corona charger 6 through a scanning optical system 10 so as to form an electrostatic latent image of the original 8 on the photosensitive layer 1*a*. The latent image thus formed is subsequently developed by a developing device 20 into a visible toner image, while a copy paper sheet 11 is fed toward the transfer charger 2 by copy paper feeding means (not shown) for transferring the developed toner image onto the copy paper 11 by the transfer charger 2. The copy paper 11 onto which the toner image is thus transferred is separated from the photosensitive layer 1*a* by the separating device 3 and is further fed to a fixing device (not shown) by a transportation belt 12 movably supported by a plurality of rollers, and then discharging onto a tray (not shown) after the transferred toner image has been fixed to the copy paper 11 by the fixing device.

Figure 3:
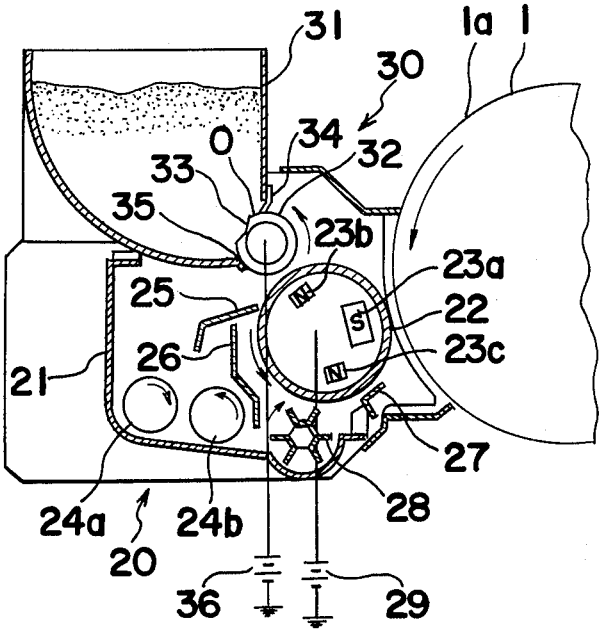
FIG. 3 is a side sectional view showing, on an enlarged scale, a developing device having an automatic toner supplying arrangement which is employed in the copying apparatus of FIG. 2.

As shown in FIG. 3, the magnetic brush type developing device 20 having an automatic toner supplying arrangement 30 directly related to the present invention includes a developing sleeve or outer cylinder 22 rotatably disposed within a developing material or developer tank 21 in a position adjacent to the photosensitive drum 1 for rotation in the counterclockwise direction, stationary magnets 23*a*, 23*b* and 23*c* fixedly disposed within the developing sleeve 22, stirring rollers 24*a* and 24*b* rotatably disposed adjacent to the left side bottom wall of the developer tank 21 for rotation in opposite directions to each other, a developing material scraping plate 25 disposed so as to extend over the developing sleeve 22 and stirring rollers 24*a* and 24*b*, a partition plate 26 provided below the scraping plate 25 between the developing sleeve 22 and the rollers 24*a* and 24*b*, a stirring member 28 rotatably disposed between the developing sleeve 22 and bottom wall of the developer tank 21, and a magnetic brush height restricting plate 27 provided adjacent to the surface of the sleeve 22 for restricting the height of the magnetic brush bristles to be formed on the developing sleeve 22.

The developing sleeve 22 impressed with a suitable bias voltage by a bias voltage source 29 forms, as it rotates, magnetic brush bristles of the known two-component developing material composed of magnetizable carrier beads and triboelectrically chargeable toner particles on its peripheral surface by the magnetic force of the stationary magnets 23*a*, 23*b* and 23*c* enclosed in said sleeve 22 and causes the bristles to rub against the electrostatic latent image formed on the photosensitive surface 1*a* for developing the latent image into a visible toner image.

The automatic toner supplying arrangement 30 includes a toner tank or hopper 31 provided above the developer tank 21 for storing the toner therein and has at its lower portion an opening O for supplying the toner therethrough, a toner supplying and collecting roller 32 of electrically conductive material rotatably mounted in the opening O of the toner tank 31 for rotation in the counterclockwise direction, a seal member 34 secured to the edge of the opening O above the roller 32 for contact with said roller 32, and a blade 35 made of a suitable resilient material and provided at the lower edge of the opening O also for contact with the surface of the roller 32. The toner supplying and collecting roller 32 which serves to replenish toner and also recover or collect toner is disposed close to the developing sleeve 22 and extends in a direction parallel to the axis of the sleeve 22 so as to confront the magnet 23*b* in the sleeve 22 which is positionally offset from the photoreceptor layer 1*a* of the drum 1, and is impressed by a toner collecting voltage source 36 with a bias voltage corresponding to the state of the original 8 as described in detail later so as to produce a potential difference with respect to the bias voltage applied to the developing sleeve 22. More specifically, the toner supplying and collecting roller 32 is rotated or moved in a direction opposite to that of the developing sleeve 22 at a position close to said sleeve 22 so that the magnetic brush bristles of the developing material formed on the developing sleeve 22 by the magnet 23*b* after the developing rub against the surface of said roller 32. In the peripheral surface of the toner supplying and collecting roller 32, there are formed a plurality of toner supplying recesses 33 extending in the axial direction of the roller 32, each processed to facilitate mechanical adhesion of the toner thereto, for example, by forming therein a minute undulation or many grooves and the like. The recesses 33 are intended to supply part of the toner in the toner tank 31 into the developer tank 21 by gravity as the roller 32 rotates, and also to transport the other part of the toner mechanically and electrostatically adhering thereto up to a position where it contacts the magnetic brush bristles formed on the developing sleeve 22 by the action of the magnet 23*b*. The blade 35 contacting the peripheral surface of the roller 32 at all times functions to scrape off the toner adhering to the peripheral surface of the roller 32 in positions other than the recesses 33 into the toner tank 31, and also to fill to recesses 33 with a predetermined amount of the toner.

Meanwhile, below and adjacent to the original platform 7, there is disposed a detecting means 13 (FIG. 2) including a lamp 13*a* and a reflection density detector 13*b* for detecting the density of the original 8 and coupled with the toner collecting voltage source 36 through a comparing means 14, a memorizing means 15 and a voltage control means 16. The detection signal generated by the detection means 13 is compared with a reference density in the comparing means 14, with a resultant comparison signal therefrom being further applied to the memorizing means 15, in which a signal is applied to the voltage control portion 16 only during copying of an original to be copied for varying the voltage of the toner collecting voltage source 36.

Figure 4:
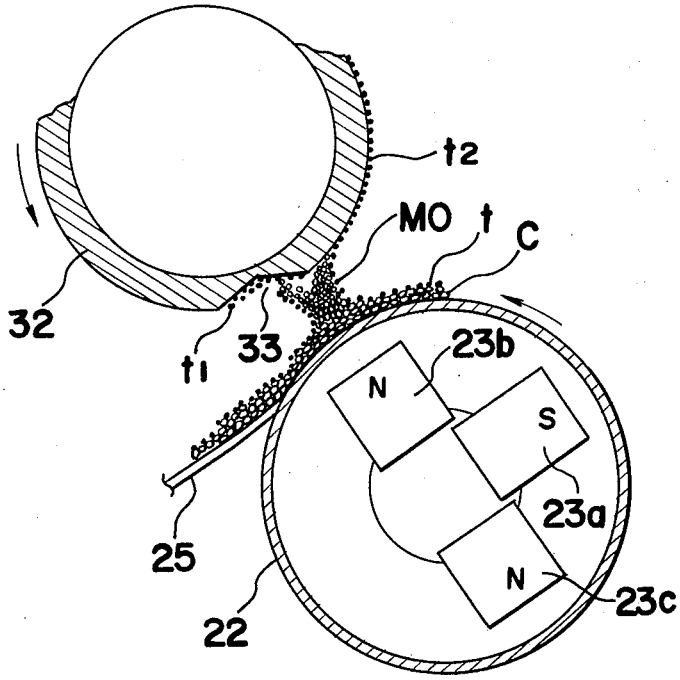
FIG. 4 is a schematic side sectional view showing, on a still more greatly enlarged scale, a toner supplying and collecting roller and a developing sleeve which are employed in the arrangement of FIG. 3 and explanatory of movement of developing material.

Referring now to FIG. 4, the movement and functioning of the developing material (i.e. toner particles and carrier beads) will be described hereinbelow.

In the first place, prior to the copying, after the density of the original 8 has been detected by the detecting means 13, the scanning optical system 10 is moved to start the normal copying operation, while at the same time, a voltage corresponding to the reflection density of the original 8 is applied to the toner supplying and collecting roller 32. Following the counterclockwise rotation of the toner supplying and collecting roller 32, the recesses 33 of the roller 32 are filled with the predetermined amount of toner t by the action of the forward edge of the blade 35 as said recesses 33 pass through the interior of the toner tank 31, and continue to move toward the position close to and confronting the developing sleeve 22. A part of the toner t filled in the recesses 33 falls off said recesses 33 by gravity as it approaches the developing sleeve 22 for being mixed with the developing material on the developing sleeve 22, and the other part $t_1$ of the toner t continues to move toward the magnetic brush MO formed on the sleeve 22 by the stationary magnet **23*b* while adhering to the recesses 33** through mechanical and electrostatic attraction.

On the other hand, the toner t is consumed by developing the electrostatic latent image formed on the photosensitive drum 1 following the counterclockwise rotation of the developing sleeve 22, and the carrier C to which only a small amount of the toner t is adhering is transported to a position confronting the toner supplying and collecting roller 32. In the above position, the carrier C is formed into the magnetic brush MO by the magnetic force of the stationary magnet **23*b*, and attracts thereto the toner $t_1$ adhering to the recesses 33 through mechanical and electrostatic attraction, by the electrostatic attraction of the carrier C which is larger than said mechanical and electrostatic attraction. Furthermore, after the recesses 33 have passed the position close to and confronting the developing sleeve 22, the magnetic brush MO is brought into sliding contact with the roller 32. In this state, since the bias voltages are impressed on the developing sleeve 22 and the roller 32 (the absolute value of the bias voltage for the roller 32 being larger than that for the developing sleeve 22), the toner t in the magnetic brush MO is electrostatically attracted onto the periphery of the roller 32 in an amount corresponding to the concentration of the developing material so as to be collected in the toner tank 31. More specifically, the toner supplying and collecting roller 32 operates to supply the toner from the toner tank 31 into the developer tank 21 through the recesses 33 thereof by the weight of the toner and the attraction of the carrier C on the developing sleeve 22**, and to collect or recover the excess toner $t_2$ after the developing by the electrostatic attraction produced by the application of the bias voltage.

Accordingly, when the electrical charge of the latent image on the photosensitive drum 1 is so small that hardly any of the toner on the developing sleeve 22 has been consumed by the developing, since the carrier particles C on the developing sleeve 22 transported to the position confronting the toner supplying and collecting roller 32 in FIG. 4 have sufficient toner particles t adhering to the peripheral faces thereof, the toner particles $t_1$ adhering to the recesses 33 of the roller 32 are not attracted by the carrier particles C, while the excessive toner particles $t_2$ of the toner attracted to the carrier particles C are collected on the peripheral surface of the roller 32.

On the contrary, when the electrical charge of the latent image on the photosensitive drum 1 is large enough to consume most of the toner during the developing, the toner particles $t_1$ adhering to the recesses 33 are attracted by the carrier particles C having almost no toner particles present on the peripheral faces thereof, while nearly no toner particles $t_2$ are collected on the peripheral surface of the roller 32.

Figure 5:
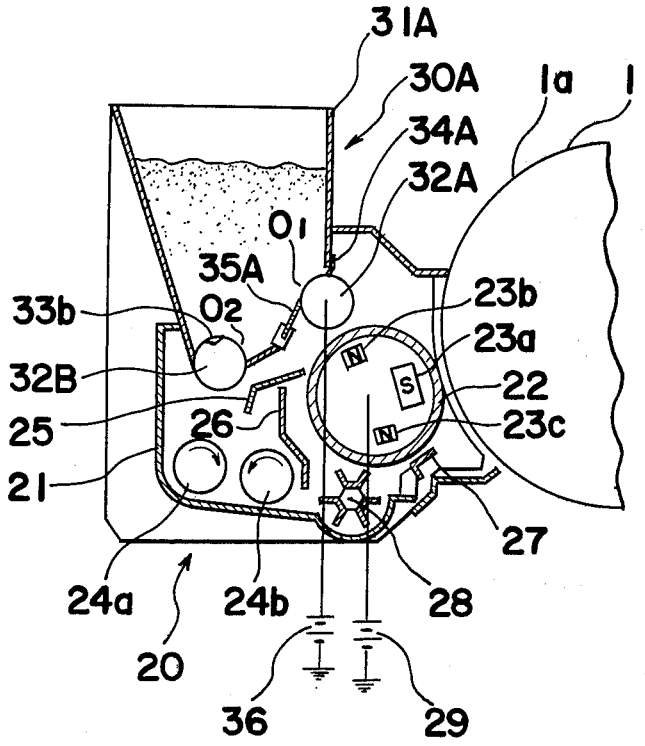
FIG. 5 is a view similar to FIG. 3, which particularly shows a modification thereof.

It is to be noted here that the arrangement of FIG. 3 described in the foregoing may be modified as shown in FIG. 5 to achieve similar effects depending on necessity. In the modification of FIG. 5, the toner supplying and collecting roller 32 described as employed in the arrangement of FIG. 2 is replaced by a toner collecting roller 32A and a toner supplying roller 32B independently provided for the toner tank 31A. More specifically, the modified automatic toner supplying arrangement 30A of FIG. 5 includes the toner collecting roller 32A rotatably provided in the opening O1 formed at the lower portion of the toner tank 31A, seal member 34A secured to the edge of the opening O1 above the roller 32A for contact with said roller 32A, and blade 35A made of a resilient material provided at the lower edge of the opening O1 for contact with the surface of the roller 32A. The toner collecting roller 32A is disposed close to the developing sleeve 22 and the axis thereof extends in a direction parallel to the axis of the sleeve 22 so as to confront the magnet **23*b* in the sleeve 22 which is positionally offset from the photoreceptor layer 1*a* of the drum 1, and roller 32A is impressed with a bias voltage corresponding to the state of the original 8 in a similar manner to the roller 32 of FIG. 3 so as to produce a potential difference with respect to the bias voltage applied to the developing sleeve 22 by the toner collecting voltage source 36 which is the bias voltage source. The toner collecting roller 32A is rotated or moved in a direction opposite to that of the developing sleeve 22 in a position close to said sleeve 22 so that the magnetic brush bristles of the developing material formed on the developing sleeve 22 by the magnet 23*b* after the developing rub against the surface of said roller 32. The automatic toner supplying arrangement 30A further includes the toner supplying roller 32B also rotatably provided in another opening O2 formed at the lowermost portion of the toner tank 31A. In the peripheral surface of the toner supplying roller 32B, there is formed a plurality of toner supplying recesses 33*b* extending parallel to the axis of the roller 32B for supplying the toner contained in the toner tank 31A into the developer tank 21 in a similar manner to the recesses 33 of the roller 32 in FIG. 3**.

Since the remaining structure and functions of the modified automatic toner supplying arrangement 30A of FIG. 5 are similar to those of the arrangement 30 of FIG. 3, a detailed description thereof is omitted for brevity.

Figure 6:
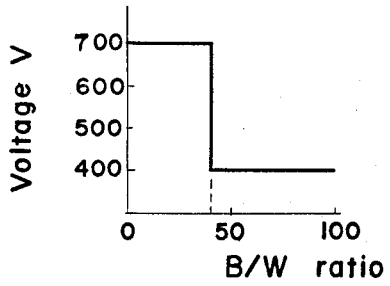
FIGS. 6 and 7 and 10 and 11 are graphs respectively showing relations between B/W ratios and voltages in the case where the voltage to be impressed on the toner collecting roller is changed over in two stages, and also the relations between the amounts of toner supplied and toner concentration by the voltage change-over.

Referring back to FIG. 3, the voltage to be impressed on the toner supplying and collecting roller 32 is controlled according to the reflection density of the original 8 detected at the detecting means 13 (FIG. 2), and is caused, according to the invention and as shown in FIG. 6, to be 700 V by the comparing means 14 when the B/W ratio (i.e. ratio of black portion to white portion of the original) is, for example, in the range of 0 to 40%, and to be 400 V when the B/W ratio is, for example, in the range of 40 to 100%. In other words, for images which require a large amount of toner, the impressed voltage is altered to a lower voltage so as to reduce the collection rate. The relation between the amount of toner supplied and toner concentration (i.e. mixing ratio of the toner to carrier) in the above case is shown in the graph of FIG. 7, in which the toner concentration (toner/carrier weight %) is on the abscissa, while the amount of toner to be consumed per second (the amount of toner adhering to the photosensitive member or adhering to the toner supplying and collecting roller so as to be collected, and the sum in g/sec. of such amounts) and the amount of toner supplied are on the ordinate.

Figure 7:
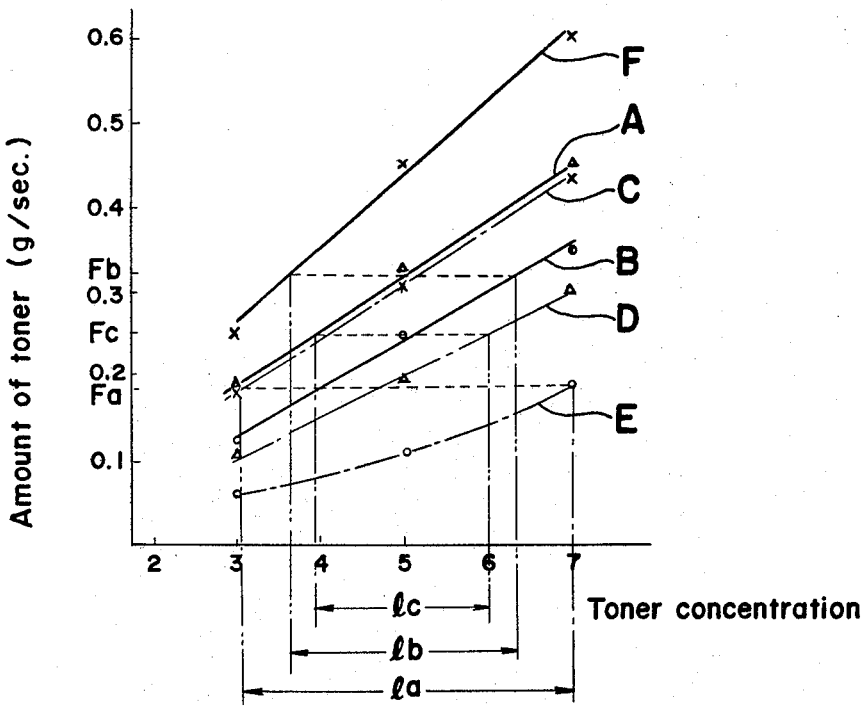

In FIG. 7, lines A and B are the curves for B/W ratios of 40% and 0% (no tone original) when the voltage impressed to the toner supplying and collecting roller 32 is 700 V, while lines C and D are the curves for B/W ratios of 100% (full tone original) and 40% when said impressed voltage is 400 V.

Figure 1:
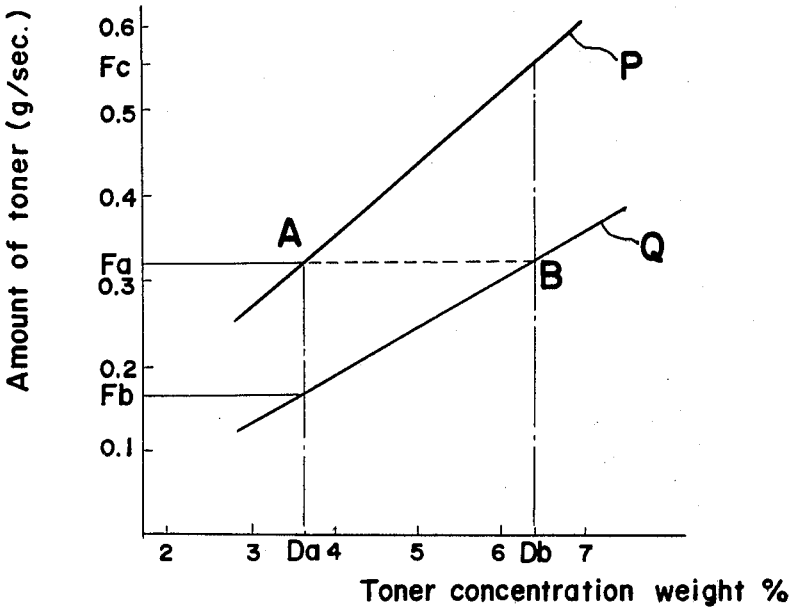
Fig. 1 (PRIOR ART)
FIG. 1 is a graph for explaining a conventional method of controlling toner concentration (already referred to)

When the impressed voltage is varied according to the density of the originals as described earlier, if the amount of toner is represented by Fc, the control of the overall concentration is to be effected in the range denoted by lc for reasons similar to those discussed in connection with FIG. 1.

Similarly, in FIG. 7, the line E is the curve for a B/W ratio of 0% when the voltage impressed on the roller 32 is 400 V, and the line F is the curve for a B/W ratio of 100% when said impressed voltage is 700 V.

Accordingly, if, instead of being controlled according to the present invention, the impressed voltage is kept constant at 400 V or 700 V for all sorts of original densities, the toner concentration will be in the range la where the amount of toner supplied is Fa at 400 V, and in the range lb where the amount of toner supplied is Fb at 700 V, and thus, it is clearly seen that the method according to the present invention has a narrower control width. It is to be noted here that in the amounts Fa, Fb and Fc of toner supplied, the central value for the toner concentration control is set to be at 5 weight %.

In the foregoing embodiment, although the impressed voltage is arranged to be altered in two stages, the toner concentration control width may further be narrowed, if the impressed voltage is arranged to be changed over in more stages.

A specific example of a case where the impressed voltage is changed over in three stages will be described hereinbelow with reference to FIGS. 12 and 13.

Figure 12:
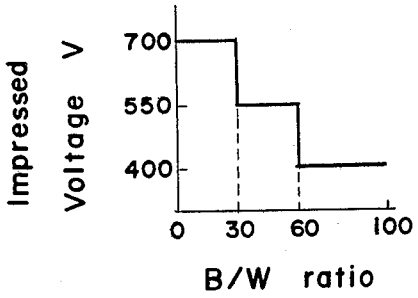
FIGS. 12 and 13 are graphs similar to FIGS. 6 and 7 and 10 and 11, which particularly relate to the case where the voltage to be impressed on the toner collecting roller is changed over in three stages.
Figure 13:
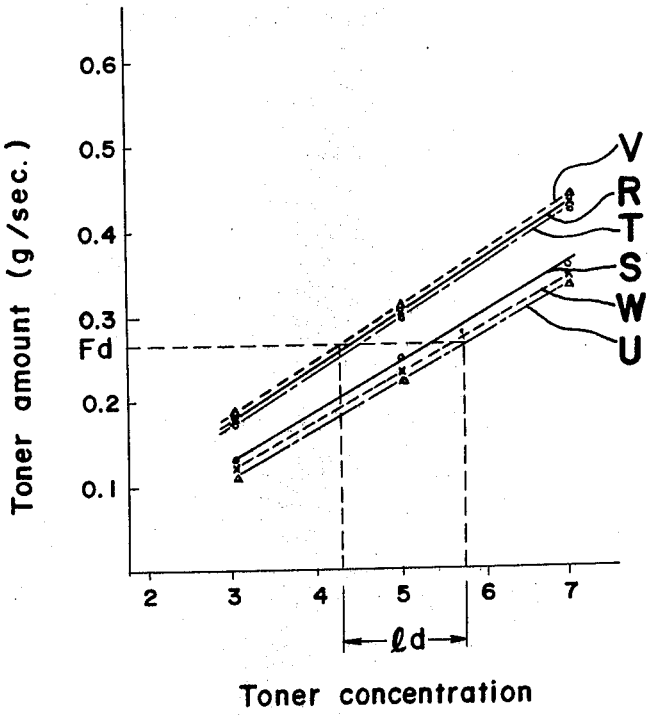

In FIG. 12, impressed voltages are arranged to be respectively changed over from 700 V to 550 V and 400 V for B/W ratios of 0 to 30%, 30 to 60% and 60 to 100%, and in FIG. 13, lines R and S are the curves for B/W ratios of 30% and 0% when the voltage impressed on the supplying and collecting roller 32 is set at 700 V, lines T and U are the curves for B/W ratios of 60% and 30% at the impressed voltage of 550 V, and lines V and W are the curves for B/W ratios of 100% and 60% with the impressed voltage set at 400 V. When the impressed voltages are varied according to the original image density as described earlier, if the amount of toner supplied is represented by Fd, the entire concentration control can be effected in the range of ld for similar reasons as those discussed in connection with FIG. 7, and thus, the width of the toner concentration control can be made narrower than for the two stage changeover described earlier.

The above fact will be readily understood from the facts that, at the same voltage, the toner consumption and collection curves come close to each other as the B/W ratios therefor approach each other, that the toner concentration variation width with respect to a predetermined amount of toner supplied becomes small as the two curves come closer to each other, and that even the curves for different B/W ratios may be brought close to each other by variation of the voltage.

Figure 8:
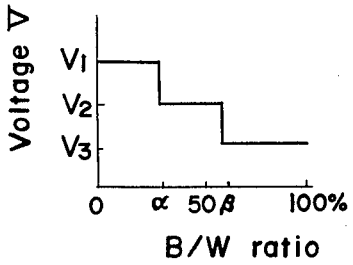
FIGS. 8 and 9 are graphs respectively showing relations between B/W ratios and voltages in the case where the voltage to be impressed on the toner collecting roller is changed over in three stages, and the relations between the amounts of toner supplied and toner concentration by the voltage change-over.
Figure 9:
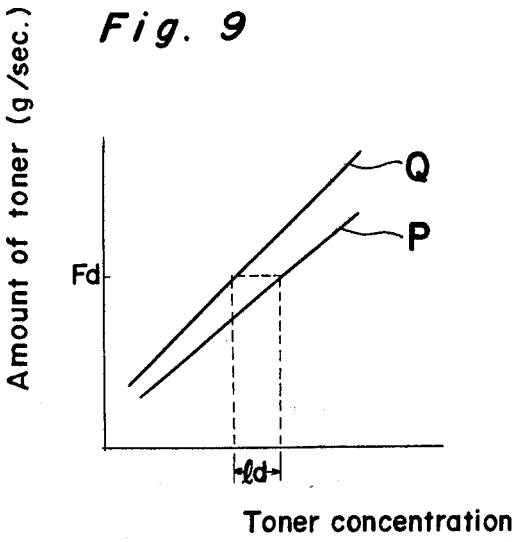

Referring to FIGS. 8 and 9, changing over of the impressed voltage three stages will be generally explained hereinbelow with reference to the specific examples of FIGS. 12 and 13 described earlier.

Since in FIG. 13 the toner consumption and collecting curve S for a B/W ratio of 0% at a voltage V1 (700 V), the curve U for a B/W ratio at $\alpha$% (30%) of a voltage V2 (550 V), and the curve W for a B/W ratio of $\beta$% (60%) at a voltage of V3 (400 V) are determined by the B/W ratios and voltages, these curves can be combined into one curve P, shown in FIG. 9, through experiments, while the voltages V1, V2 and V3 and B/W ratios $\alpha$ and $\beta$ are set so that the toner consumption and collecting curve R for a B/W ratio of $\alpha$% (30%) at a voltage V1 (700 V), the curve T for a B/W ratio of $\beta$% (60%) at a voltage V2 (550 V), and the curve V for B/W ratio of 100% at a voltage V3 (400 V) are also combined into one curve Q where the relations $V1>V2>V3$ and $\alpha<\beta$ hold.

It should be noted here that in the specific examples of FIGS. 12 and 13, although the curves S, U and W and the curves R, T and V do not perfectly coincide into single curves P and Q respectively, these curves can be brought into closer coincidence by proper selection of the voltages V1, V2 and V3 and B/W ratios $\alpha$ and $\beta$.

More specifically, as is seen from FIG. 9, the curve Q is the curve for the original density with large B/W ratios at respective voltages and similarly, the curve P is the curve for the original density with small B/W ratios at the respective voltages. Therefore, if the amount of toner supplied is represented by Fd, the toner control width may be denoted by ld. By the changing-over into many stages as described above, the control width becomes extremely narrow, since the curves P and Q are brought close to each other.

More specifically, the original density region in which the staged control is to be carried out is divided into a plurality (N) of small regions n (n: whole number, $1 \leqq n \leqq N$), and the boundary original density for each of the small regions n is set to be $\alpha_{n-1}$, $\alpha_n$ where $\alpha_O$ and $\alpha_N$ are respectively the lower limit and upper limit densities for the original density region to be subjected to the control. In the above case, if the collecting roller impressed voltage V is changed to Vn (wherein V1 and $V_N$ are respectively the upper limit and lower limit values of the impressed voltage V) with respect to each of said small regions n, with the values of $\alpha$n and Vn being set so that the toner consumption and the collecting curve at the original density $\alpha_{n-1}$ and voltage Vn in each of said small regions n and the toner consumption and collecting curve in each of the small regions n at the original density $\alpha_n$ and the voltage Vn and respectively caused to coincide approximately into two curves which are close to each other, the toner concentration is automatically balanced between the two curves very close to each other for favorable control of the toner concentration.

The relation as described above will be described in detail with reference to the two stage control illustrated in FIGS. 6 and 7.

Since the original density region to be subjected to the control in two parts, $N=2$, the small regions thereof are $n=1$, 2. The boundary original density $\alpha_{n-1}$, $\alpha_n$ in the respective small regions n is arranged to be B/W ratios $\alpha_0$ (0%) and $\alpha_1$ (40%) in the small region n=1st and to be B/W ratios $\alpha_1$ (40%) and $\alpha_2$ (100%) in the small region n=2nd, with the voltage V impressed on the collecting roller being changed over to become V1 (700 V) with respect to the small region n=1st, and V2

(400 V) with respect to the small region n=2nd, and the original density $\alpha_n$ and the impressed voltage Vn are set in such a manner that the toner consumption and collecting curve at the original density $\alpha_{n-1}$ and voltage Vn in each of the small regions n, i.e. the toner consumption and collecting curve B at $\alpha_0$ and V1 (B/W ratio 0% and voltage 700 V) in the small region n=1st, and the toner consumption and collecting curve D at $\alpha_1$ and V2 (B/W ratio 40% and voltage 400 V) in the small region n=2nd are caused to coincide in one single line P, while the toner consumption and collecting curve at the original density $\alpha_n$ and voltage Vn in the respective small regions n, i.e. the toner consumption and collecting curve A at $\alpha_1$ and V1 (B/W ratio 40% and voltage 700 V) in the small region n=1st, and the toner consumption and collecting curve C at $\alpha_2$ and V2 (B/W ratio 100% and voltage 400 V) in the small region n=2nd are caused to coincide in one single line Q. In other words, the values of $\alpha_n$ and Vn are set so that these toner consumption and collecting curves as described above are respectively caused to coincide in two curves P and Q which are close to each other.

More specifically, when the above relations are described in general for the control of N parts or regions, the values of $\alpha_n$ and Vn are set in such a manner that:

the toner consumption and collecting curves at the image density $\alpha_{n-1}$ and voltage Vn in the respective small regions n, i.e.,

| | |
|---|---|
| the toner consumption and collecting curve | at $\alpha_0$, V1 in n = 1st small region |
| the toner consumption and collecting curve | at $\alpha_1$, V2 in n = 2nd small region |
| the toner consumption and collecting curve | at $\alpha_2$, V3 in n = 3rd small region |
| . | . |
| . | . |
| . | . |
| the toner consumption and collecting curve | at $\alpha_{N-1}$, $V_N$ in n = N small region |

are caused to coincide in the single line P, while the toner consumption and collecting curves at the image density $\alpha_n$ and voltage n in the respective small regions n, i.e.,

| | |
|---|---|
| the toner consumption and collecting curve | at $\alpha_1$, V1 in n = 1st small region |
| the toner consumption and collecting curve | at $\alpha_2$, V2 in n = 2nd small region |
| the toner consumption and collecting curve | at $\alpha_3$, V3 in n = 3rd small region |
| . | . |
| . | . |
| . | . |
| the toner consumption and collecting curve | at $\alpha_N$, $V_N$ in n = N small region |

are caused to coincide in the single line Q. In other words, the values of $\alpha_n$ and Vn are set so that the toner consumption and collecting curve of $\alpha_{n-1}$ and Vn at respective small regions n and the toner consumption and collecting curve of $\alpha_n$ and Vn at respective small regions n are respectively caused to coincide in two corresponding curves P and Q close to each other.

Figure 10:
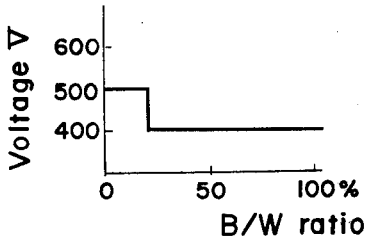
Figure 11:
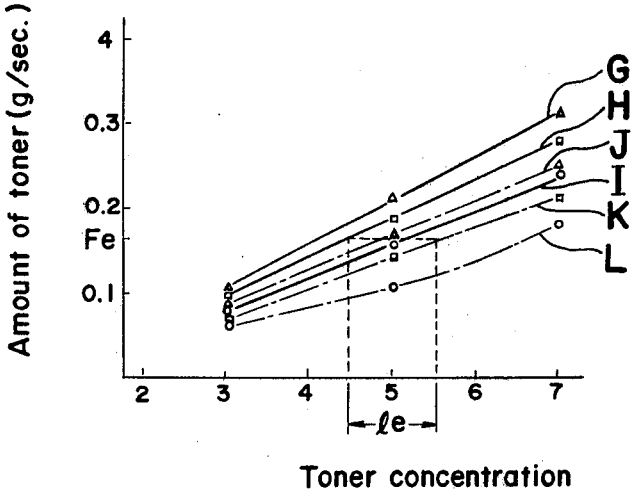

Although in the foregoing embodiments, a control capable of fully copying with B/W ratios of 0 to 100% can be achieved, actual originals with many characters, etc. have B/W ratios in the range of approximately 3 to 30%. Therefore, if it is arranged so that the important regions with low B/W ratios are controlled, a still narrower control range than in the embodiment of FIG. 7 can be achieved through the same two stage changing-over. For this purpose, for example, as shown in FIGS. 10 and 11, the impressed voltages are set to be 500 V for the B/W ratios of 0 to 20%, and 400 V for the B/W ratios of 20 to 100%. In the above case, when the amount of toner supplied is set to be Fe, the concentration control is effected between the curves H and I for the originals having B/W ratios of 0 to 20%, and between the curves J and K for the originals having B/W ratios of 20 to 35%. Therefore, for the originals having B/W ratios in the range of 0 to 35%, the toner concentration is controlled in the range le. If originals with a B/W ratio higher than 35% are continuously copied, the toner concentration begins to be lowered beyond the range le, but if the number of copies to be made is small, the shifting is trivial, and the toner concentration returns into the range le when copying an original with B/W ratios in the range of 0 to 35% again.

In FIG. 11, it is to be noted that the lines H, I, J, K, G and L respectively represent the toner consumption and collecting curves for a B/W ratio of 20% at the impressed voltage of 500 V, for a B/W ratio of 0% at the impressed voltage of 500 V, for a B/W ratio of 35% at the impressed voltage of 400 V, for a B/W ratio of 20% at the impressed voltage of 400 V, for a B/W ratio of 35% at the impressed voltage of 500 V, and for a B/W ratio of 0% at the impressed voltage of 400 V.

It should be noted here that, in the foregoing embodiments, although the setting is made on the assumption that the B/W ratios of ordinary originals are low, for making many copies of particular originals with a high B/W ratio, the control may, needless to say, be effected with emphasis on the region of high B/W ratios.

It should also be noted that, in the method according to the present invention which is arranged to change over the voltage impressed on the toner supplying and collection roller so as to correspond to the B/W ratio of the original, the measurement of the B/W ratio of the original as described earlier may be modified to detect the B/W ratio of the transfer paper 11 after the developing by a detection means 13A disposed above the transportation belt 12 as shown in dotted lines in FIG. 2. In the above case, although the control is delayed by one sheet, this will present no inconvenience in actual practice.

Furthermore, since the B/W ratio of the original is proportional to the electrical charge of the electrostatic latent image to be formed on the photosensitive member through the corona charging and image exposure, it is possible to arrange to control voltage by measuring the amount of charge of the electrostatic latent image by a conventional charge detecting means 13c also shown in dotted lines in FIG. 2.

It should further be noted that the voltage changeover may be effected for each sheet of the original or for the average value of a plurality of sheets of originals, and that the present invention may be applied to the toner concentration control method disclosed in the earlier mentioned Japanese Laid Open Patent Application Tokkaisho No. 52-63739.

As is clear from the foregoing description, according to the present invention, in the toner concentration control method for an electrophotographic copying apparatus in which the toner collecting roller impressed with a voltage opposite to that of the toner is disposed to contact the flow of the developing material including said toner and carrier after the developing so as to collect the toner corresponding to the concentration of said developing material and simultaneously to supply approximately the predetermined amount of toner for replenishment, the voltage to be impressed on the toner collecting roller is controlled so as to be varied in more than two stages so that a voltage lower than that for the standard density images is applied to images requiring a large toner consumption, while a voltage higher than that for the standard density images is applied to images requiring a small toner consumption, and therefore, the control device can be given a simplified construction, with consequent reduction in size. Moreover, since the variation in width of the toner concentration is small as compared with that in the conventional methods, with a smaller amount of supplied toner required, the increase of the toner charging is not caused to deteriorate even if no particular stirring device is used, and the staining within the copying apparatus due to scattering of the toner does not readily take place.

Referring back to FIGS. 6 and 7, a change from control in stages or stepped control to a continuous or stepless control will be described hereinbelow with reference to the general description of the specific examples of FIGS. 6 and 7.

When the curve B for B/W ratio αHD 0 (0%) and voltage V1 (700 V) and the curve C for B/W ratio $\alpha_2$ (100%) and voltage V2 (400 V) are approximately equivalent to the two curves P and Q and close to each other, with the upper and lower limits of the voltages being set to be V1 (700 V) and V2 (400 V), the toner concentration control width for all the original densities of B/W ratio $\alpha_0$ (0%) to $\alpha_2$ (100%) does not become narrower than between the curves B and C. In the above state, making the toner concentration width still narrower, i.e., bringing the curves P and Q still closer, can be achieved if the curve for B/W ratio $\alpha_0$ (0%) and voltage V1 and the curve for B/W ratio $\alpha_2$ (100%) and voltage V2 come closer to each other, and the larger the difference between V1 and V2, the closer the two curves P and Q. In the above state, when the curve for B/W ratio $\alpha_0$ (0%) and voltage V1 and the curve for B/W ratio $\alpha_2$ (100%) and voltage V2 are brought into coincidence, with the voltages being varied in the relation of 1:1 between V1 and V2 corresponding to the variation of B/W ratios between $\alpha_0$ (0%) and $\alpha_2$ (100%) so as to follow one curve, the stepless control to be described later with reference to FIG. 16 can be achieved.

It is to be noted here that in the stepless control to be described hereinbelow, the stepless control may similarly be achieved if the stepped control is made continuous.

Referring to FIGS. 14 to 17, another method of controlling the toner concentration i.e. the stepless or continuous control of the toner concentration according to a further embodiment of the present invention will be described. It is to be noted that the arrangements of FIGS. 3 and 5 may also be employed for effecting the method of FIGS. 14 to 17.

Figure 14:
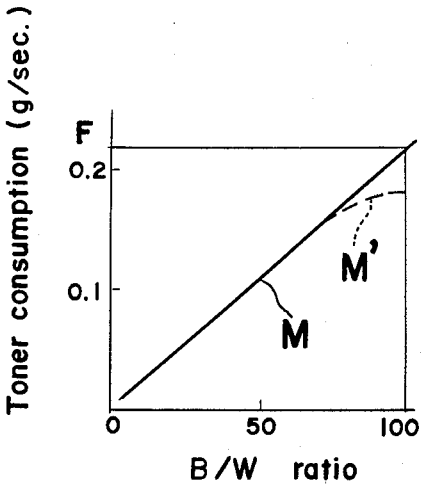
FIG. 14 is a graph showing the relation between B/W ratio and toner consumption according to another embodiment of the present invention.
Figure 15:
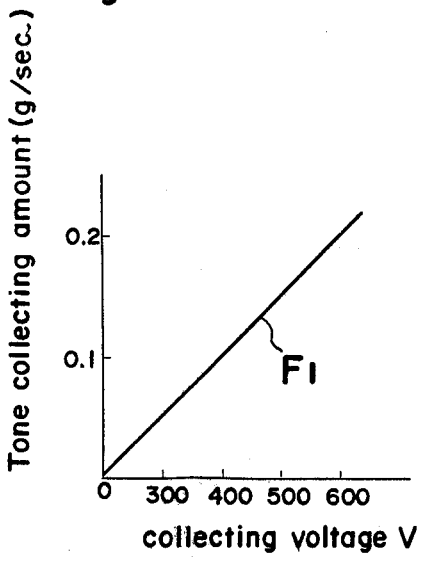
FIG. 15 is a graph showing the relation between the impressed voltage and amount of toner collected.

The voltage to be impressed on the toner supplying and collecting roller 32 is to be controlled according to the reflecting density of the original 8 detected by the detecting means 13 (FIG. 2) to a voltage value for collecting the difference between the amount of the toner consumed and the amount of toner supplied. More specifically, the toner consumption represented by M varies in approximately a straight line relation to variation of the B/W ratio (i.e. ratio of black portion to white portion of the original) as shown in FIG. 14, and on the assumption that the amount of toner supplied is represented by F, in the case where the B/W ratio is 100% (equivalent to a full tone original), the toner concentration can be maintained constant, with proper balancing between the replenishing and consumption of the toner, but in the originals having low B/W ratios, the amount of toner (F-M) equivalent to the difference between the amount of toner supplied F and the amount of toner consumed M becomes excessive, and the toner concentration within the developer tank 21 is undesirably increased gradually. In the present invention, it is intended to collect an amount of toner equivalent to said difference for maintaining the toner concentration constant at all times. For the above purpose, attention has been directed to the fact that the relation between the voltage V impressed on the toner collecting roller 32 and the amount of toner collected F1 at the constant tone concentration is represented by approximately a linear relation as shown in FIG. 15 (for the toner concentration at 5 weight %). Since the relation between the B/W ratio and impressed voltage V for which the amount of toner collected F1 becomes equal to the amount (F-M) in FIG. 14, is approximately a straight line such as the line Y of FIG. 16, the toner concentration can be maintained constant, if the impressed voltage V on the toner collecting roller 32 is varied as in FIG. 16 according to the variation of the B/W ratio.

Figure 16:
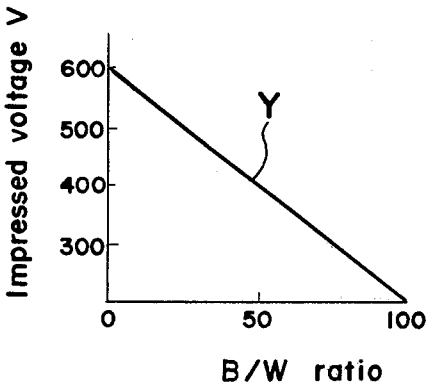
FIG. 16 is a graph showing the relation between B/W ratio and the impressed voltage in which the amount of toner collected becomes equal to the difference between the amount of toner supplied and toner consumption.
Figure 17:
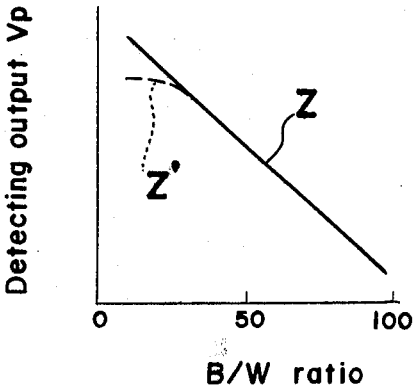
FIG. 17 is a graph showing the relation between B/W ratio and detecting output.

As is seen from the above description, in the embodiment of FIGS. 14 to 17 according to the present invention, the voltages of FIG. 16 are impressed on the toner collecting roller 32 according to the reflecting density of the original 8, i.e. the variation of the B/W ratio, and the variation of the impressed voltage V according to the B/W ratio can be achieved by setting the output Vp of the detection signal from the detecting means 13 (FIG. 2) to a value which will satisfy the relation in FIG. 16, i.e. by measuring the output Vp of the detection signal corresponding to the variation of the B/W ratio as in the curve Z in FIG. 17 for setting the impressed voltage so as to satisfy the relation of FIG. 16 with respect to said output Vp. Additionally, the control is assured by memorizing said signal detected from the detecting means 13 in the memorizing means 15 as an input for the voltage control means 16 for a predetermined period of time, for example, during the functioning of the developing device 20.

It is to be noted here that, although there may be cases where the toner consumption has along a curve M' as shown by the dotted line in FIG. 14 according to the characteristics of toners, this will present no inconvenince, since in such a case, if the detected B/W ratio is caused to vary as shown by a dotted line Z' in FIG. 17, an amount of toner (F-M') approximately corresponding thereto can be collected, and it is seldom that originals with a B/W ratio higher than 50% are copied in actual practice.

It should also be noted here that in the foregoing, although the method of controlling the toner concentration of the invention is described with reference to the case where the voltages corresponding to the B/W ratios of the originals as shown in FIG. 16 are applied to the toner supplying and collecting roller, the method of the present invention may readily be applied also to the toner concentration control arrangement in which the separate toner supplying roller is provided in addition to the toner collecting roller for supplying the predetermined amount of toner at all times as in the arrangement shown in FIG. 5 and disposed, for example, in Japanese Laid Open Patent Application Tokkaisho No. 52-63739 mentioned earlier.

Another point to be noted here is that, although the comparing means 14 (FIG. 2) is required for the stepped control, such comparing means is not necessary in the case of the stepless control of FIGS. 14 to 17.

More specifically, in the stepped control, the comparing means 14 compares the reference density with the original density as stated earlier. The above function is necessary for comparing the original density detected by the detecting means 13 with the reference densities (divided density regions) to see if the original density is equivalent to one or the other of the divided original density regions so as to generate the comparing signal for changing over the corresponding set impressed voltage by the voltage controlling means 16 according to said equivalent original density region.

On the contrary, in the stepless control, it is possible to input the image density detected by the detecting means 13 as it is as a voltage control signal for changing over the voltage corresponding to the original density at the voltage control means 16.

As is clear from the foregoing description, according to the toner concentration control method of the present invention described with reference to FIGS. 14 to 17, since the voltage to be impressed on the toner collecting roller is continuously varied to the voltages for collecting the difference between the amount of toner consumed and amount of toner supplied so as to correspond to the state of the original images, the width of the variation in the toner concentration is very small as compared with that in conventional methods, while the advantages described with reference to FIGS. 5 to 10 are also achieved.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. A method of controlling toner concentration for an electrophotographic copying apparatus including a developing device for developing an electrostatic latent image formed on a photosensitive member into a visible toner image with a two-component developing material which is composed of triboelectrically chargeable toner and magnetizable carrier and fed to a developing station by a developing sleeve having a plurality of magnets arranged in the interior thereof, said method comprising the steps of collecting an amount of toner corresponding to the concentration of the developing material from the toner left on said developing sleeve after developing the image by means of a toner collecting roller impressed with a voltage opposite in polarity to the toner and rotatably disposed to contact the flow of said developing material on said developing sleeve at a point past, in the direction of movement of the developing material, the position at which the developing sleeve supplies the toner to the photosensitive member, supplying approximately a predetermined constant amount of toner to said developing sleeve for replenishing the toner thus collected, and varying the voltage impressed on said toner collecting roller so as to correspond to the state of image to be copied.

2. A method of controlling toner concentration as claimed in claim 1, wherein said voltage impressed on said toner collecting roller is varied in response to the image density of an original to be copied.

3. A method of controlling toner concentration as claimed in claim 1, wherein said voltage impressed on said toner collecting roller is varied in response to the image density of a copied image formed on copy paper after developing.

4. A method of controlling toner concentration as claimed in claim 1, wherein said voltage impressed on said toner collecting roller is varied in response to the electrical charge of the electrostatic latent image formed on the photosensitive member.

5. A method of controlling toner concentration as claimed in claim 1, wherein said voltage impressed on said toner collecting roller is varied by changing said impressed voltage in more than two stages and a voltage lower than that for a reference density image is applied thereto for an image requiring a large amount of toner, and a voltage higher than that for the reference density image is applied for the image requiring a small amount of toner.

6. A method of controlling toner concentration as claimed in claim 5, further including the steps of dividing a range of densities of originals to be copied into a plurality of N of small regions n in which n is a whole number and N and n are in the relation $1 \leqq n \leqq N$, setting a boundary density of an original for each of the small regions at $\alpha_{n-1}$, $\alpha_n$ wherein $\alpha_n$ is the density at the limit of the densities of the density region, changing the voltage V impressed on the toner collecting roller to Vn wherein Vn is the lower limit of the impressed voltage V for the corresponding small regions n, and setting the values of $\alpha_n$ and Vn so that the toner consumption and collecting curves at the density of the original $\alpha_{n-1}$ and voltage Vn in each of said small regions n and the toner consumption and collecting curve at the density $\alpha_n$ and voltage Vn in each of said small regions n are respectively caused to coincide approximately into two curves which are close to each other.

7. A method of controlling toner concentration as claimed in claim 6, wherein said range of densities of the originals to be copied is the entire range of densities of the originals.

8. A method of controlling toner concentration as claimed in claim 6, wherein said range of densities of the originals is the low density region of the entire range of densities.

9. A method of controlling toner concentration as claimed in claim 1, wherein said voltage impressed on said toner collecting roller is by changing said impressed voltage in two stages and, when the entire range of densities of originals to be copied is divided into two regions, one of high density and one of low density, a high voltage is impressed on the toner collecting roller for images in the low density region, and a low voltage is impressed on said toner collecting roller for images in the high density region.

10. A method of controlling toner concentration as claimed in claim 1, wherein said voltage impressed on said toner collecting roller is varied by changing said impressed voltage in two stages and, when a specific range of densities within the entire range of densities of originals to be copied is divided into two regions, a high voltage is impressed on said toner collecting roller for images in the low density region of said two regions, and a low voltage is impressed on said toner collecting roller for images in the high density region of said two regions.

11. A method of controlling toner concentration as claimed in claim 10, wherein said specific range of densities is on the low density end of the entire range of densities.

12. A method of controlling toner concentration as claimed in claim 1, wherein said voltage impressed on said toner collecting roller is varied by changing said impressed voltage in three stages and, when the entire range of densities of originals to be copied is divided into three regions, a low density region, a medium density region and a high density region, a high voltage is impressed on said toner collecting roller for images in the low density region, a medium value voltage is impressed on said toner collecting roller for images in the medium density region, and a low voltage is impressed on said toner collecting roller for images in the high density region.

13. A method of controlling toner concentration as claimed in claim 1, wherein said voltage impressed on said toner collecting roller is continuously varied for collecting the difference between the amount of toner consumed for developing the image and said predetermined amount of toner supplied.

14. A method of controlling toner concentration as claimed in claim 13, wherein said voltage impressed on said toner collecting roller is varied to a low voltage for an image requiring a large amount of toner and to a high voltage for an image requiring a small amount of toner.

15. A method of controlling toner concentration for an electrophotographic copying apparatus including a developing device for developing an electrostatic latent image formed on a photosensitive member into a visible toner image with a two-component developing material which is composed of triboelectrically chargeable toner and magnetizable carrier and fed to a developing station by a developing sleeve having a plurality of magnets arranged in the interior thereof, said method comprising the steps of collecting an amount of toner corresponding to the density of the image being copied from the toner left on said developing sleeve after developing the image by means of a toner collecting roller rotatably disposed to contact the flow of said developing material on said developing sleeve at a point past, in the direction of movement of the developing material, the position at which the developing sleeve supplies the toner to the photosensitive member and impressed with a voltage corresponding to the density of the image and opposite in polarity to the toner; picking up a quantity of developer in a recess in the toner collector roller from a supply of toner, causing a first amount of toner to fall by gravity from said recess onto said developing sleeve for replenishing the toner; carrying a further amount of toner in said recess to said developing sleeve corresponding to the density of the image being copied for replenishing the toner collected; and varying the voltage impressed on said toner collecting roller so as to correspond to the density of image being copied.

* * * * *